United States Patent [19]

van der Smissen et al.

[11] Patent Number: 4,807,614

[45] Date of Patent: Feb. 28, 1989

[54] PROTECTIVE HOOD

[75] Inventors: Carl E. van der Smissen, Lübeck; Holmer Röhling, Reinfeld, both of Fed. Rep. of Germany

[73] Assignee: Drägerwerk Aktiengesellschaft, Lübeck, Fed. Rep. of Germany

[21] Appl. No.: 147,279

[22] Filed: Jan. 22, 1988

[30] Foreign Application Priority Data

Jan. 22, 1987 [DE] Fed. Rep. of Germany ..... 3701695

[51] Int. Cl.[4] ..... A62B 17/04

[52] U.S. Cl. ..... 128/201.23; 128/201.28; 128/205.12; 128/201.25; 55/DIG. 35

[58] Field of Search ..... 128/201.18, 201.19, 128/201.23, 201.28, 201.17, 206.24, 206.13, 202.13, 201.22, 201.25, 205.12, 205.27, 205.29, 206.12, 206.15, 206.17, 206.19, 206.21; 55/DIG. 35

[56] References Cited

U.S. PATENT DOCUMENTS

| | | | |
|---|---|---|---|
| 1,410,928 | 3/1922 | Knoblock | 128/206.26 |
| 2,435,167 | 1/1948 | Stetson | 128/201.23 |
| 4,026,296 | 5/1977 | Stoy et al. | 128/207.15 |
| 4,502,480 | 3/1985 | Yamamoto | 128/201.25 |
| 4,572,178 | 2/1986 | Takase et al. | 128/201.25 |
| 4,573,464 | 3/1986 | Yo | 128/206.15 |
| 4,619,254 | 10/1986 | Moretti et al. | 128/201.23 |
| 4,627,431 | 12/1986 | Werjefelt | 128/201.28 |
| 4,637,383 | 1/1987 | Lopez | 128/201.25 |
| 4,643,182 | 2/1987 | Klein | 128/206.19 |
| 4,683,880 | 8/1987 | Werjefelt | 128/201.28 |

FOREIGN PATENT DOCUMENTS

| | | | |
|---|---|---|---|
| 2164570 | 3/1986 | United Kingdom | 128/201.25 |

*Primary Examiner*—Edgar S. Burr
*Assistant Examiner*—Kimberly L. Asher
*Attorney, Agent, or Firm*—Walter Ottesen

[57] ABSTRACT

The invention is directed to a protective hood for an emergency which is formed in part by a permeable strip-like piece holding back dust-like harmful substances. At least in the region of the eyes, the protective hood has a section made of transparent material and the hood also includes an inner half-mask with a breathing air inlet and an exhalation valve. The protective hood is improved by reducing the resistance to inhalation and expanding the protection against harmful gaseous components. This protection is achieved in that the strip-like piece is made of a nonwoven fabric which is provided with a preparation holding back also gaseous harmful substances and includes a breathing air inlet in the form of an inhalation valve for admitting breathing air.

8 Claims, 3 Drawing Sheets

PROTECTIVE HOOD

FIELD OF THE INVENTION

The invention relates to a protective hood for emergencies which: is formed in part from a permeable strip for holding back dust-like harmful substances; has a section made of a transparent material at least in the region of the eyes; and, has an inner half-mask having a breathing air inlet and an exhalation valve.

BACKGROUND OF THE INVENTION

A protective hood of the kind described above is disclosed in U.S. Pat. No. 2,435,167. Protective hoods for emergencies are preferably utilized for rescuing persons from rooms which are in danger of burning and in which smoke and dust occur because of the fire. However, these protective hoods also serve to protect the breathing of aircraft passengers who require additional breathing support in the event of decompression in the passenger cabin or in the event that a fire breaks out. The breathing support can be in the form of protection from breathable harmful substances and/or in the enrichment of the breathing air with oxygen.

The known protective hood comprises a material which is permeable to air and water and yet keeps back dust. This known protective hood has an inner half-mask with an inlet opening which opens into the inner space of the hood and through which the person wearing the hood can inhale the air. Exhalation occurs via an exhalation valve which starts at the inner half-mask and opens to the ambient. The finest dust can possibly penetrate through the intermediate spaces of the hood. In order to also keep this fine dust from the respiratory system of the person wearing the hood, the inlet opening is provided with a further dust filter. The flow resistance of this inlet opening must be significantly greater than that of the exhalation valve in order to suppress an inhalation of the exhaled air by the wearer. This makes breathing more difficult.

With known protective hoods, it is a disadvantage that they can only protect the person wearing the hood against dust with an inlet opening having a considerable inhalation resistance being necessary to keep back the finest dust. Also, there is no protection against gaseous harmful substances which penetrate the fabric of the hood and can irritate the eyes and skin as well as impair breathing. The protruding configuration of the inhalation opening and outlet valve prevent the entire hood from being packed in a space-saving manner and is therefore restrictive in the tight space relationships present in an aircraft or restrictive when carried by the user.

A further protective hood is disclosed in published German Patent Application DE-OS No. 31 38 697.

This protective hood serves to completely cover the head and is in the form of a hood made of a fabric which is configured as a filter by means of interlayered active charcoal. A tunnel-like spacer is attachable over the mouth-nose region to prevent the body of the hood from lying tightly against the nose and mouth of the person wearing the hood. If the body of the hood were permitted to lie against the nose and mouth, free breathing would be prevented and a premature exhaustion of the protective effect through excessive respiration would occur.

Breathing occurs over the entire surface of the hood with the inhalation as well as the exhalation taking place undirected across the intermediate space between the head of the wearer and the hood itself. This causes an undesired high respirated dead space to occur which can lead to excessive enrichment with carbon dioxide and water vapor with long continuous breathing activity.

SUMMARY OF THE INVENTION

In view of the above, it is an object of the invention to provide a protective hood of the above-mentioned type which is improved such that its inhalation resistance is reduced with a small respirated dead space. It is a further object of the invention to provide such a protective hood having a reduced height and weight and wherein its range of use is extended so that the breathing passages as well as the surface of the head are protected against harmful gases.

According to a feature of the protective hood of the invention, the strip-like piece is made of a nonwoven fabric which is provided with a preparation for also keeping back gaseous harmful substances. The protective hood of the invention includes an inhalation valve through which the breathing air enters.

The advantages achieved with the invention are essentially that the large-area, low-resistance nonwoven fabric is adequate as the only filter and a reduced inhalation resistance is achieved by means of an easily responding inhalation valve. The inhalation valve prevents a transition of the breathing air into a dead space which can lead to a dangerous enrichment of carbon dioxide and an oxygen depletion of the flow of inhaled air. The protective effect of the filtering strip-like piece is expanded to additional gaseous harmful substances in accordance with the selection of the impregnation. In this way, the region of the head is protected against these harmful environmental influences. Since no further blocking filters are present with the exception of the assembled filter piece, the protective hood constitutes a handy and easily portable small emergency package which is ready for immediate use.

An especially effective preparation can be provided by filling out the nonwoven material with activated charcoal or aluminum oxide which is provided with an impregnation. In this connection, the activated charcoal can be a granular material worked into the nonwoven fabric or it can comprise activated charcoal fibers which are tied into the nonwoven fabric. The utilization of activated charcoal fibers affords the advantage that they function as a fabric structure as well as being worked into the hood as a nonwoven fabric and therefore perform a self-carrying function.

The nonwoven fabric can be provided with any one of the following impregnations: copper-chromium, zinc, or copper-chromium and zinc for filtering out hydrogen cyanide, for example. An impregnation with precious metals from the platinum group can be provided as a protection against carbon monoxide. The platinum group includes ruthenium, rhodium, palladium, osmium, iridium, platinum, iron, cobalt and nickel.

Enriching the breathing gas with oxygen is desirable in such cases in which a deficiency in oxygen must be considered. For this purpose, the inner half-mask of the protective hood is provided with an additional connecting piece incorporating a switching valve. A breathing gas supply is connectable to this connecting piece. The connecting piece is closed against the penetration of unclean outer air when the protective hood is utilized strictly as a filter apparatus. On the other hand, the connecting piece is opened when the connecting piece is connected to a breathing gas supply.

As required, the person wearing the protective hood can connect an external oxygen source to the half-mask as a breathing gas supply. Such an oxygen source can for example be that which is readily available in the supply system of an aircraft. On the other hand, when using the protective hood in the mining industry, a portable oxygen source can be carried along. In this way, the half-mask is useable for enriching the breathing air with oxygen as well as for an escape situation from areas which are in danger of burning or are enriched with harmful substances as, for example, is required during a rescue operation from a burning aircraft or in the case of a hotel fire.

The switching valve can preferably be so configured that the gas passage into the inner half-mask is opened by coupling to the breathing gas supply and the through passage of ambient air is prevented when the inner half-mask is uncoupled from the breathing gas supply. The forced switching of the valve when performing the coupling operation ensures that no serious consequences will occur under conditions of panic in an emergency situation.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
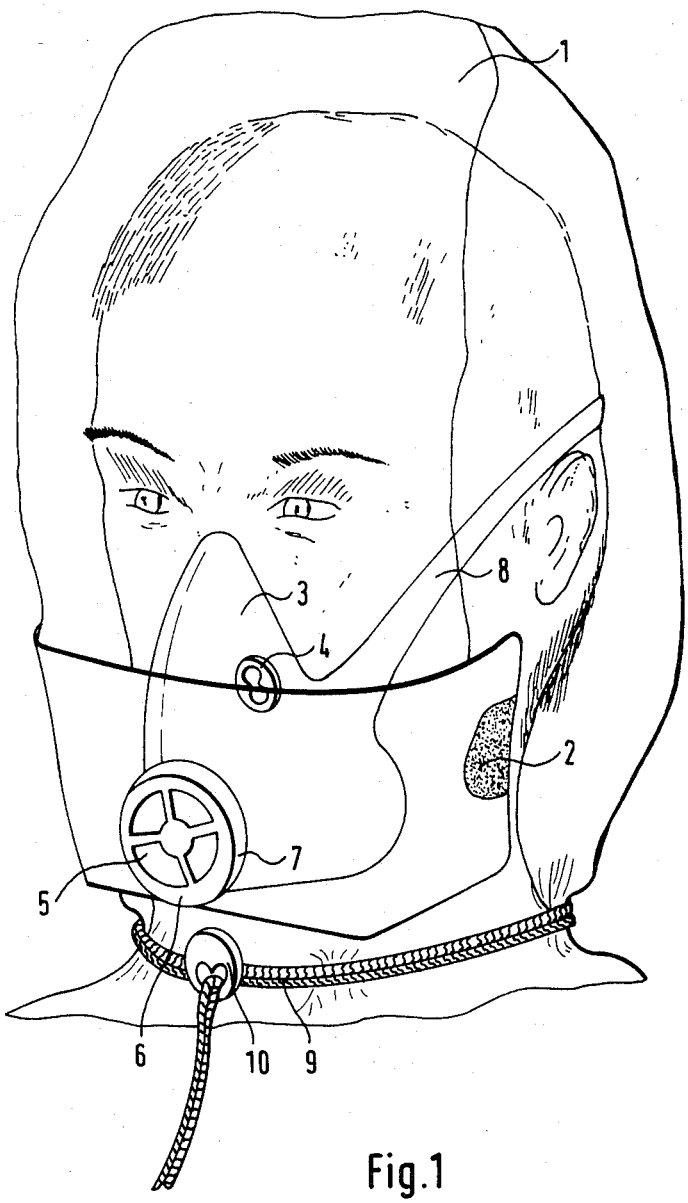
FIG. 1 is a perspective view of the protective hood according to the invention having a nonwoven fabric filter.

FIG. 1 shows the protective hood 1 according to the invention fitted over the head of a wearer. The protective hood is made of transparent material and is provided with a strip-like piece 2 made of a nonwoven fabric. The strip-like piece 2 extends over the hood in the region of an inner half-mask 3 covering the nose and mouth of the wearer. The strip-like piece 2 is opaque, however, the inner half-mask 3 is shown to be visible through the piece 2 for the purposes of explanation and understanding.

Figure 3A:
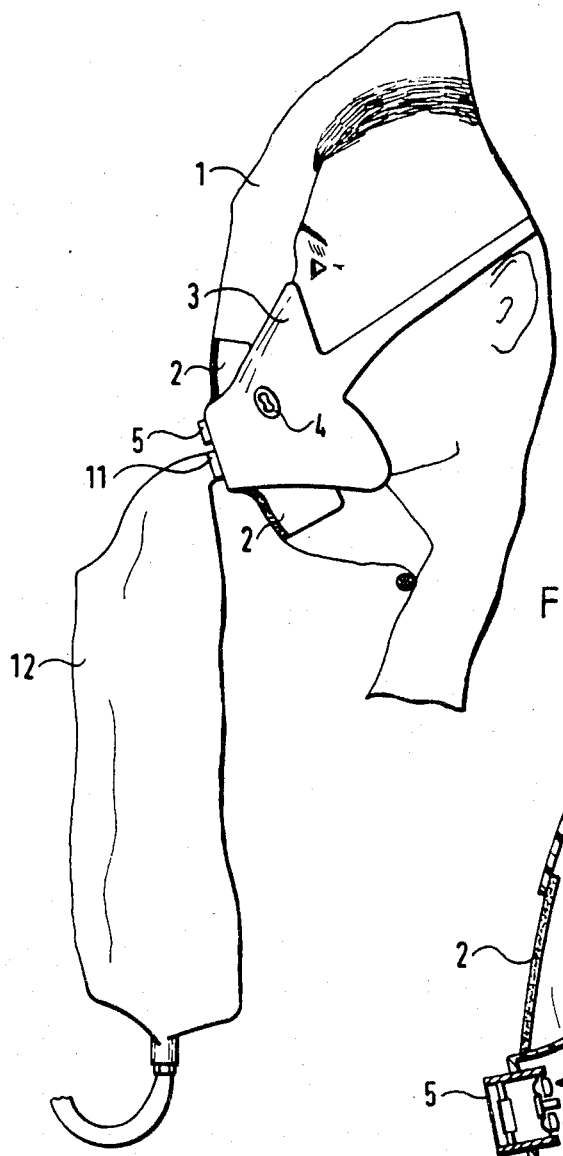
FIG. 3*a* is a side elevation view showing the protective hood connected to the oxygen supply via a breathing bag; and, FIG. 3*b* is a side elevation view, enlarged and in section, taken through the mask region of the protective hood of FIG. 3*a*.
Figure 3B:
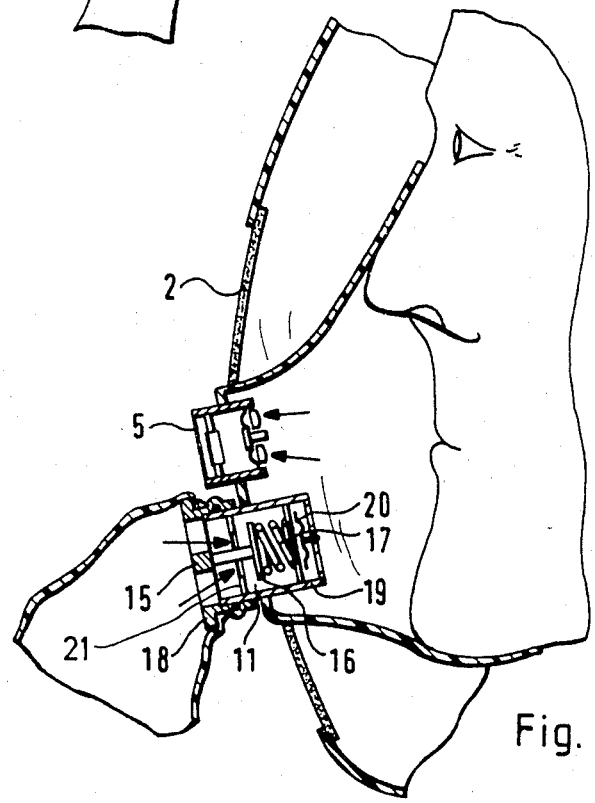

The inner half-mask 2 is provided with an inhalation valve 4 which opens into the intermediate space between the hood 1 and the head of the wearer and makes possible a flow from the hood space into the interior of the half-mask 3. The half-mask 3 further includes an exhalation valve 5 leading to the ambient. The exhalation valve 5 is disposed on the end piece 6 of the half-mask 3 to which the strip-like piece 2 is attached via a protruding portion 7. As shown in FIG. 3*b*, the exhalation valve 5 communicates directly with the ambient thereby completely bypassing the filter piece 2. A band 8 tightly seats the half-mask 3. A tying cord 9 provides a sealing closure of the hood 1 in the neck region of the wearer and is led through an eyelet 10.

Figure 2:
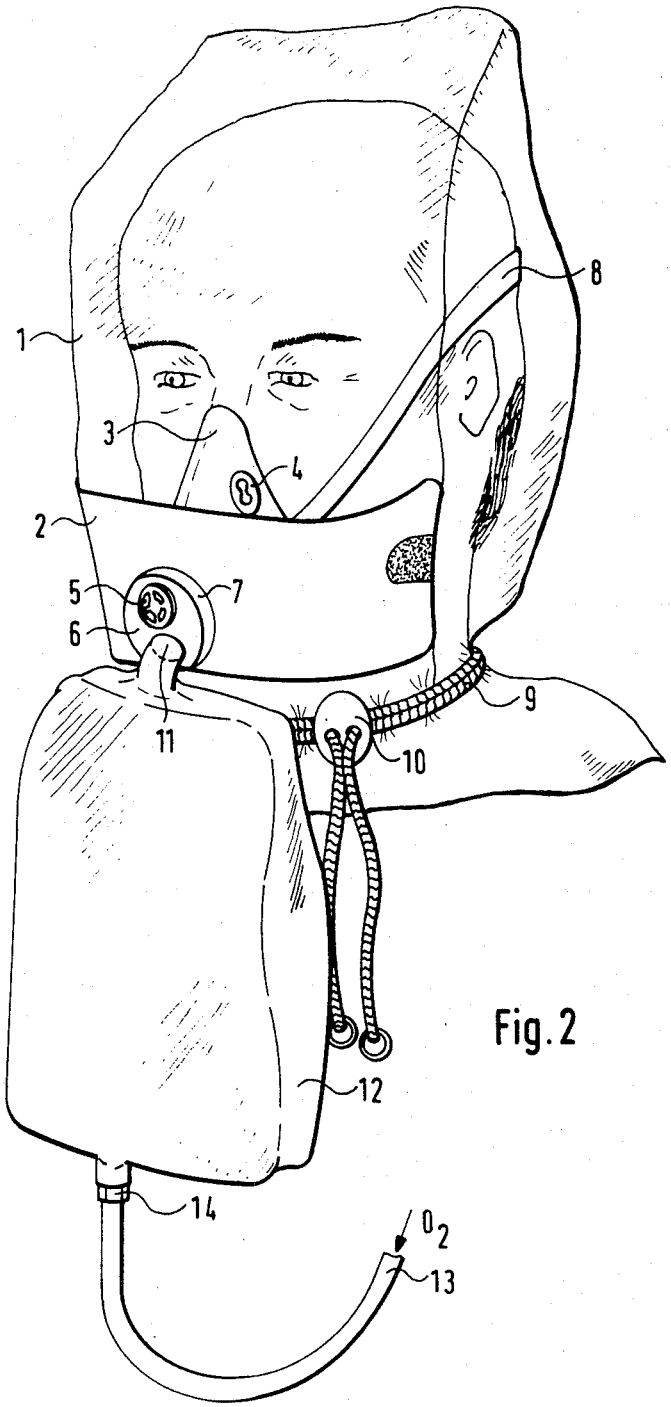
FIG. 2 is a perspective view of the protective hood according to the invention connected to an oxygen supply.

In FIG. 2, the protective hood 1 is supplemented with a switching valve 11 located on the end piece 6 of its inner half-mask 3. A breathing bag 12 is connected to the switching valve 11 and is fillable with additional oxygen via a supply line 13 from a gas source (not shown) such as the supply system of an aircraft, bottle or chemical cartridge. The supply line 13 is connected to the breathing bag 12 via a stub 14.

Referring to FIG. 3*b*, the breathing bag 12 has a coupling sleeve 18 which engages over the housing 19 of the switching valve 11. When the sleeve 18 is placed in position over housing 19, an actuating piece 15 mounted in the coupling sleeve 18 opens a spring-loaded closure element 16 and clears the path into the inner space of the half-mask 3. A check valve 20 prevents return breathing into the breathing bag 12. When the breathing bag 12 is removed, the spring 17 presses the closure piece 16 against its seat 21 and also prevents ambient air from penetrating into the half-mask 3 during the inhalation phase.

It is understood that the foregoing description is that of the preferred embodiments of the invention and that various changes and modifications may be made thereto without departing from the spirit and scope of the invention as defined in the appended claims.

What is claimed is:

1. A protective hood arrangement for emergencies comprising:

a hood adapted to be placed over the head of a wearer and having a first portion made of transparent material at least in the region adjacent the eyes of the wearer;

a permeable piece defining a further portion of said hood and being a filter made of nonwoven fabric;

preparation means disposed in said nonwoven fabric for holding back harmful substances including gaseous harmful substances;

a half-mask arranged in said hood, said hood and said half-mask conjointly defining a closed space when worn by the wearer, the half-mask including a breathing air inhalation valve communicating directly with said permeable piece so as to define a clear and unobstructed path over which the wearer inhales air from the ambient through said permeable piece;

said half-mask further including an exhalation valve communicating directly with the ambient thereby completely bypassing said permeable piece and compelling the wearer to exhale to the ambient; and, an ancillary breathing gas supply arrangement for supplying additional breathing gas to the wearer when required by the latter to supplement the breathing gas obtained through said inhalation valve; said breathing gas supply arrangement including:

breathing gas supply means disposed externally of said hood and said half-mask for supplying additional breathing gas;

passage means mounted on said half-mask so as to extend out past said hood to the ambient for conducting said additional breathing gas into the interior of said half-mask;

connecting means for releasably connecting said breathing gas supply means to said passage means when said additional breathing gas is needed by the wearer; and, closure means for closing off said passage means from the ambient when said breathing gas supply means is disconnected from said passage means.

2. The protective hood arrangement of claim 1, said preparation means comprising an activated charcoal impregnation in said strip-like piece.

3. The protective hood arrangement of claim 2, said preparation means further comprising a copper/-chromium impregnation in said strip-like piece for holding back and filtering out hydrogen cyanide.

4. The protective hood arrangement of claim 2, said preparation means further comprising a platinum-metal group impregnation for holding back carbon monoxide.

5. The protective hood arrangement of claim 1, said preparation means comprising a copper/chromium impregnation in said strip-like piece for holding back and filtering out hydrogen cyanide.

6. The protective hood arrangement of claim 1, said preparation means comprising at least one metal selected from the platinum group of metals impregnated in said strip-like piece for holding back carbon monoxide.

7. The protective hood arrangement of claim 1, said passage means including a housing defining a passage extending from the ambient into the interior of the half-mask; said closure means including: a valve seat formed in said passage, a valve body mounted in said passage so as to be movable between a first position wherein said valve body is in contact second position wherein said passage is clear, and biasing means for biasing said valve body into said first position and against each valve seat; said connecting means including attachment means for attaching said breathing gas supply means to said housing so as to permit the additional breathing gas to enter said passage; and, structure means disposed on said attachment means for engaging said valve body and displacing the latter into said second position when said attachment means is attached to said housing.

8. A protective hood arrangement for emergencies comprising:

a hood adapted to be place over the head of a wearer and having a first portion made of transparent material at least in the region adjacent the eyes of the wearer;

a permeable large-area piece defining a further portion of said hood and being a filter made of nonwoven fabric;

preparation means disposed in said nonwoven fabric for holding back harmful substances including gaseous harmful substances;

a half-mask arranged in and attached to said hood, said hood and said half-mask conjointly defining a closed space when worn by the wearer, the half-mask including a breathing air inhalation valve communicating directly with said permeable large-area piece so as to define a clear and unobstructed path over which the wearer inhales air from the ambient through said permeable large-area piece; and, said half-mask further including en exhalation valve communicating directly with the ambient thereby completely bypassing said permeable piece and compelling the wearer to exhale to the ambient.

* * * * *

UNITED STATES PATENT AND TRADEMARK OFFICE

CERTIFICATE OF CORRECTION

PATENT NO. : 4,807,614

DATED : February 28, 1989

INVENTOR(S) : Carl E. van der Smissen and Holmer Röhling

It is certified that error appears in the above-identified patent and that said Letters Patent is hereby corrected as shown below:

In column 5, line 31: between "contact" and "second" insert -- engagement with said valve seat to close said passage and a --.

In column 5, line 33: delete "each" and substitute -- said -- therefor.

In column 6, line 10: delete "place" and substitute -- placed -- therefor.

In column 6, line 29: delete "en" and substitute -- an -- therefor.

Signed and Sealed this

Twentieth Day of June, 1989

*Attest:*

*Attesting Officer*

DONALD J. QUIGG

*Commissioner of Patents and Trademarks*